United States Patent [19]

Ratay

[11] 4,078,095

[45] Mar. 7, 1978

[54] SLURRY PROCESS FOR COATING PARTICLES UPON THE VIEWING-WINDOW SURFACE OF A CATHODE-RAY TUBE

[75] Inventor: John Michael Ratay, Peckville, Pa.

[73] Assignee: RCA Corporation, New York, N.Y.

[21] Appl. No.: 455,835

[22] Filed: Mar. 28, 1974

[51] Int. Cl.[2] ..... H01J 29/04

[52] U.S. Cl. ..... 427/72; 427/68; 427/73; 427/232; 427/346; 427/374 R; 427/398 R

[58] Field of Search ..... 117/33.5 C, 33.5 CS, 117/102 A; 96/36.1; 427/72, 73, 68, 232, 346, 374, 398

[56] References Cited

U.S. PATENT DOCUMENTS

| | | | |
|---|---|---|---|
| 3,269,838 | 8/1966 | Saulwier | 117/33.5 C |
| 3,364,054 | 1/1968 | Weingarten | 117/335 C |
| 3,376,153 | 4/1968 | Fiore | 117/33.5 C |
| 3,467,059 | 9/1969 | Korner et al. | 117/33.5 CM |
| 3,635,751 | 1/1972 | Long et al. | 117/33.5 C |
| 3,652,323 | 3/1972 | Smith | 117/33.5 C |
| 3,653,939 | 4/1972 | Prazak | 117/33.5 CP |
| 3,653,941 | 4/1972 | Bell et al. | 117/33.5 C |
| 3,672,932 | 6/1972 | D'Augustine | 117/33.5 C |
| 3,700,444 | 10/1972 | Miller et al. | 117/33.5 CP |
| 3,703,401 | 11/1972 | Deal et al. | 117/335 CM |
| 3,808,048 | 4/1974 | Strik | 117/33.5 C |

*Primary Examiner*—Bernard D. Pianalto
*Attorney, Agent, or Firm*—G. H. Bruestle; L. Greenspan

[57] ABSTRACT

Method comprises heating the viewing window of a cathode-ray tube to temperatures above 35° C, dispensing from a storage container onto a surface of said window a quantity of slurry comprised of particulate material mixed with a liquid vehicle, the quantity of slurry being in excess of that required to coat said surface, spreading the quantity of slurry over the surface whereby the slurry is heated by the window, collecting the excess slurry from the surface and returning it to the storage container, and removing the heat transferred to the excess slurry from the window.

9 Claims, 1 Drawing Figure

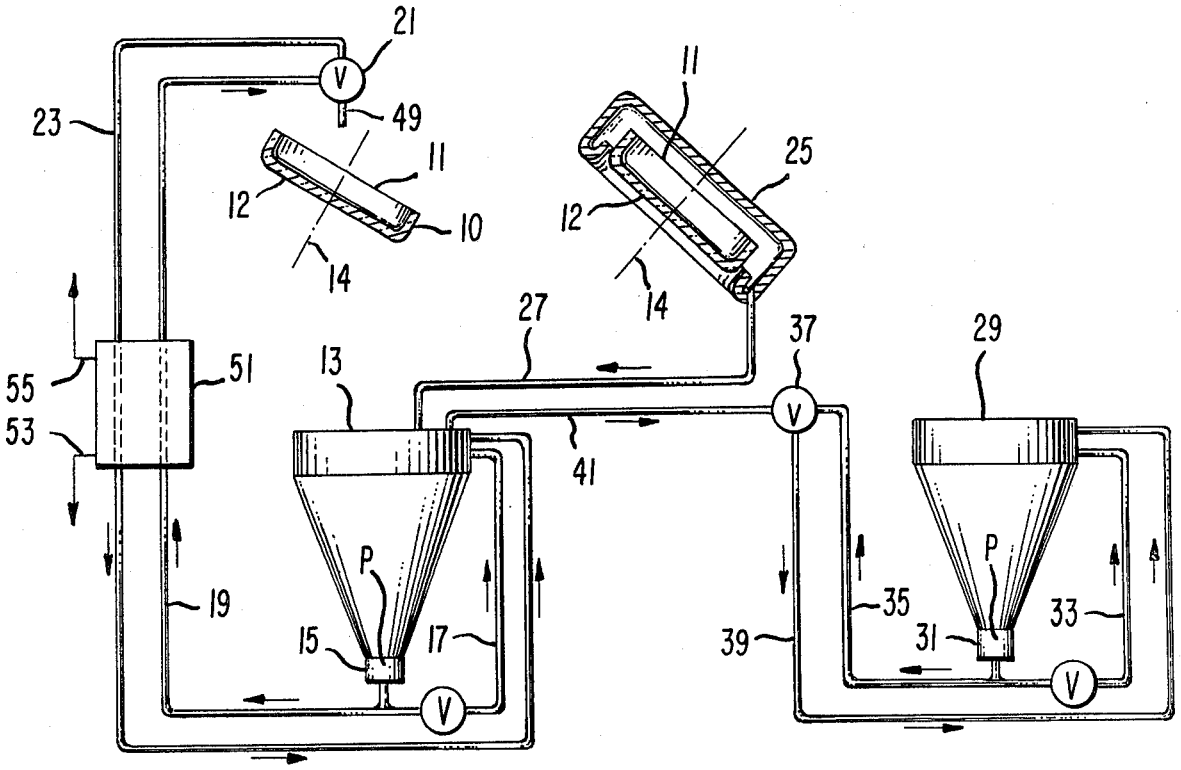
21
V
49
23
11
12
10
14
11
25
12
14
27
37
29
55
51
53
13
41
V
P
19
15
17
V
39
35
31
33
P
V

SLURRY PROCESS FOR COATING PARTICLES UPON THE VIEWING-WINDOW SURFACE OF A CATHODE-RAY TUBE

BACKGROUND OF THE INVENTION

This invention relates to a novel method for coating particulate material upon a viewing-window surface of a cathode-ray tube. The novel method is particularly applied to coating a layer of phosphor particles upon the inner surface of the viewing windows of a series of cathode-ray tubes; for example, color-television picture tubes.

In one method of making a phosphor screen for a color-television picture tube, a slurry is prepared which includes phosphor particles, a binder such as polyvinyl alcohol, a photosensitizer for the binder such as ammonium dichromate, an organic filter resin, and a liquid vehicle such as water. In a previous factory process, a series of viewin windows is passed through a semiautomatic machine. A puddle of phosphor slurry is dispensed from a storage container onto the central portion of the inner surface of each slowly-rotating viewing window, which window is part of the faceplate panel of a cathode-ray tube. Each window is rotated and tilted to spread the slurry puddle outwardly to the margins of the window, thereby coating the slurry over the entire window surface. During the spreading step, the coated slurry circulates over the surface and some of the particles therein settle as a layer on the window surface. The excess slurry is then removed, as by rapidly spinning the panel to sling the excess slurry from the panel, recovered, and returned to the storage container, where it is mixed with the slurry therein, and the miture used for coating subsequent window surfaces.

With prior slurry coating factory practice, at the time of dispensing, the slurry has a variable temperature, usually in the range of 26° to 30° C, and a variable viscosity of about 50 to 60 centipoises; and the viewing window has a temperature of about 35° to 40° C. The higher viscosity permits a relatively thick uniform layer of slurry, free of streaks and sags, to be formed on the window surface. As the slurry is spread on the window surface, it is heated to a temperature of about 33° to 38° C with a consequent decrease in viscosity, and phosphor particles settle as a layer upon the surface. The lower viscosity permits the phosphor particles to settle as a uniform layer in the short period of time permitted by the machine cycle. The settled layer that is formed is relatively porous with a screen weight of about 2.50 to 3.60 mg/cm$^2$.

One expedient for increasing the screen weight without losing adherence of the layer to the surface is to heat the viewing window to higher temperatures, usually in the range of 40° to 50° C at the time of dispensing the slurry. When this is done, the slurry puddle is heated (during spreading) to higher temperatures with still greater decreases in viscosity. The excess slurry that is collected and returned to the storage container, being hotter, raises the temperature of the mixed slurry in the storage container causing its viscosity to drop. There are also corresponding increases in the temperature and decreases in the viscosity of the dispensed slurry. The overall effect of raising the temperature of the viewing window is to disturb the entire system, at times causing catastrophic reductions in the adherence and in the quality of the settled layer.

SUMMARY OF THE INVENTION

In the novel method, a quantity of slurry from a storage container is dispensed onto the viewing-window surface that has been heated to temperatures above 35° C. The slurry is spread over the surface and the excess slurry is collected and returned to the storage container. Unlike the prior process, the heat picked up from the viewing window by the excess slurry is removed, so that the temperature and viscosity of the subsequently-dispensed mixed slurry remain substantially constant. The heat may be removed by cooling the excess slurry as it is returned to the storage container, or by cooling the mixed slurry in the storage container or, preferably, by cooling the mixed slurry just prior to dispensing.

By removing the variable amounts of heat that are picked up and carried by the salvage slurry from prior coating operations, the coating operation is commenced with mixed slurry having substantially the same temperature and viscosity for each of the successive surfaces to be coated. The losses in adherence and screen quality previously experienced are thereby avoided.

It is further appreciated that it is advantageous to dispense a slurry having a temperature lower than 22° C and a viscosity of about 30 to 50 centipoises at the time of dispensing. By employing the lower slurry temperature, the slurry can be compounded to contain less organic binder and/or less or no organic filler resin than was employed previously. As the slurry is spread over the surface, the temperature of the slurry rises and the viscosity drops a greater amount than by previous processes. Both of these factors (higher window temperature and less organic material in the slurry) contribute to a more rapid and more complete deposition of particles from the slurry to form a heavier and less porous layer than is produced by prior methods. Weights of 3.8 to 4.3 mg/cm$^2$ are easily achieved. In addition, it has been found to be practical for the surface to have a higher temperature, up to 50° C, whereby an even greater drop in viscosity may be achieved during the slurry-spreading step.

In one form of the invention, the viewing window is at average temperatures of about 42° to 50° C. In the preferred form, the surface temperature is graded from center to edge, with the central portion of the surface at about 44° to 48° C, and the edge portions of the surface are about 3° to 5° C lower. The higher viewing-window temperatures provide a more rapid and more complete deposition of particles into a heavier, less porous layer. The graded temperature helps produce a layer that is graded in thickness from center to edge as desired.

BRIEF DESCRIPTION OF THE DRAWING

The sole FIGURE is a schematic layout of a system for dispensing slurry and recycling the recovered excess slurry that employs the novel method.

DESCRIPTION OF THE PREFERRED EMBODIMENTS

The preferred embodiments are described with respect to coating the inner surface of the viewing windows of a series of cathode-ray tubes, particularly color-television picture tubes. In this preferred method, each of three phosphors (red-emitting, green-emitting, and blue-emitting) is incorporated into a separate slurry, is separately coated on the inner surface of each window, and then is processed to produce a phosphor dot pattern. The pattern may be of other materials than of phosphors, and may be in other shapes than dots; for example, there may be arrays of lines or other shapes. Apparatus for carrying out the coating step are disclosed in the prior art; for example, U.S. Pat. Nos. 2,902,973 to M. R. Weingarten; 3,364,054 to M. R. Weingarten; 3,672,932 to F. T. D'Augustine; and 3,653,941 to B. B. Bell et al.

In the system shown in the sole FIGURE, a faceplate panel 11 is held in a work holder (not shown), which is rotated and tilted to carry out the method steps. The work holder may move from station to station where the various method steps in the fabrication process are carried out. As part of this fabrication, a puddle of slurry is dispensed onto each window surface. The slurry is stored in a dispenser storage container 13 and is continually agitated by pumping the slurry with a pump 15 through a dispenser recirculating line 17 back to the container 13 and also through the dispenser feed line 19, through a dispensing means including a dispenser three-way valve 21 and a dispenser return line 23 back to the dispenser storage container 13. When a quantity of slurry is to be dispensed, the three-way valve 21 is actuated to release a metered quantity of slurry through a dispensing nozzle 49 onto the panel 11. The apparatus includes also a water-cooled heat exchanger 51 through which pass the dispensing feed line 19 and the return feed line 23. Cooling water passes into the water jacket through an inlet 53 and leaves by an outlet 55.

The work holder is made to rotate and tilt according to a prescribed program for the purpose of producing a coating or layer of phosphor particles on the surface of the viewing window of the panel. The rate of rotation and the angle of title of the rotation axis are adjusted to cause a puddle of phosphor slurry to spiral outwardly around the inner surface of the viewing window until the entire surface has been covered. Then, the excess slurry material is removed and the removed excess slurry is returned to the slurry storage container for use on subsequent panels to be coated. As shown in the sole FIGURE, the panel 11 is moved to another station, where a circular toroidal-shaped trough 25 is positioned around the rotating panel 11. The panel 11 is made to rotate fast enough to fling the excess slurry from the panel 11 by centrifugal force into the trough 25. The collected excess slurry drains from the trough 25 back to the dispenser storage container 13 through a drain return line 27.

The slurry that has been used to coat the panel 11 is replaced by makeup slurry that is stored in a makeup slurry storage container 29. The makeup slurry is continuously agitated by pumping the slurry with a pump 31 through a makeup recirculating line 33 back to the container 29 and also through a makeup feed line 35, a makeup feeding means including a makeup three-way valve 37 and a makeup return line 39 back to the container 29. When a quantity of makeup slurry is called for, the makeup three-way valve 37 is actuated to release the desired quantity of makeup slurry into the dispenser storage container 13 through a connecting line 41.

A typical faceplate panel 11 is a unitary glass structure comprised of a glass viewing window, which has a viewing window 12 that is generally concave on the inside, flatlike and nonporous. The panel 11 has sidewalls 10 which rise along the margins of the viewing window 12 and terminate with the seal land, which is subsequently sealed to the seal land of the funnel portion of the tube. In this embodiment, the viewing window 12 has a generally rectangular shape; however, the viewing window may be of any shape; for example, it may be round. The panel 11 is mounted in the work holder of the coating apparatus, and the panel and work holder are made to rotate about an axis 14 which is normal to and passes through the central portion (a generalized region) of the inner surface of the viewing window 12. The axis 14 of rotation may be tilted from vertical by a tilt angle.

The rotating panel 11 is subjected to several preliminary processing steps on the coating apparatus which includes heating the panel so that the temperature of the viewing window is at about the temperatures indicated in the TABLE for the respective phosphor slurries indicated. In one form of the invention, the central portion of the surface is at about 44° to 48° C and the edge portions are at about 40° to 44° C. However, the temperature of the surface may be substantially constant from center to edge and may be at any temperature above about 35° C.

A metered amount of slurry is dispensed as a puddle onto the central portion of the inner surface of the viewing window 12, which is facing upward. Prior to dispensing, the slurry in the dispenser storage container has a variable temperature of about 23° to 25° C or lower. The slurry temperature may be at higher temperatures up to about 30° C as in the prior art. On the way to and from the dispensing means, the slurry is passed through the water-cooled heat exchanger 51, where the slurry is cooled to a substantially constant temperature in the range of about 17° to 22° C. Specific temperatures for each phosphor slurry are indicated in the TABLE.

A lesser proportion of organic binder and organic filler resin is required to impart the required viscosity to the slurry at the time of dispensing than for prior formulations. Typically, the weight ratio of polyvinyl alcohol to phosphor is dropped from about 0.12 (0.11 – 0.13) to about 0.09 (0.08 – 0.10), and the weight ratio of filler resin to polyvinyl alcohol is dropped from 0.50 – 1.00 to about 0.05. This reduction in organic material in the slurry is achieved because the slurry is cooler at the time of dispensing, which raises the viscosity of the dispensed slurry. The reduced proportion of organic material in the slurry permits uniform, less porous layers of particles to be formed by the slurrycoating method. The less porous layers subsequently yield screens which exhibit higher luminescent light output.

The dispensed slurry is formed into a puddle and is spread over the inside window surface by the rotation of the panel 11 and by the tilting of the rotation axis. The puddle referred to herein is a quantity of slurry which moves over the window surface as an entity having a leading edge and leaving a trail of material behind. The puddle may pick up material from previous trails during its travel over the surface. The material left behind generally moves downwardly by gravity so that the slurry is constantly distributing itself over the surface, obliterating the edges of previous trails and to some extent draining back into the puddle.

As the puddle travels over the surface, the slurry is warmed by the heat in the panel and the panel is correspondingly cooled. The slurry temperature is estimated to rise to temperatures of about 30° to 35° C in this embodiment. This causes the viscosity of the slurry to drop from the viscosities at dispensing indicated in the TABLE to relatively low values below 25 centipoises. This drop in viscosity permits particles in the slurry to settle by gravity onto the window surface at a more rapid rate than by prior processes. Also, more of the particles settle out of the slurry because of the lower viscosity.

The reduced proportion of organic material and the much increased drop in viscosity of the slurry during spreading permit the settled particles to pack together into a less porous layer than by prior processes. The presence of voids in the settled layer is easily detected in a finished cathode-ray tube. When the layer is excited by an electron beam, the particles luminesce. However, close examination shows a void in the layer to appear as a dark spot which is not emitting light. The relative amount of area of the layer which appears as dark spots is substantially lower in layers prepared by the novel method.

The tilt angle of the rotation axis and the speed of rotation of the surface are selected to produce the desired spreading of the slurry as in the prior art. Also, the viscosity, specific gravity, and other characteristics of the slurry are selected to give the desired effect in combination with the tilt angle of the axis, and the rotational speed of the panel. Some suitable phosphor slurries, which may be modified as described herein, are described in U.S. Pat. Nos. 3,269,838 to T. A. Sulnier and 3,313,643 to P. B. Branin. Suitable slurries usually have viscosities at the dispensing nozzle; that is, at the time of dispensing, in the range of about 30 to 50 centipoises, and preferably in the range of about 35 to 45 centipoises.

After the spreading of the slurry over the surface is completed, the panel is spun rapidly to sling the excess slurry out of the panel by centrifugal force. The excess slurry which is spun off in this manner is caught and returned to the dispenser storage container 13. The returned salvage slurry and the makeup slurry are mixed in with the slurry in the dispenser storage container 13 to form a mixed or reconstituted slurry for use in coating subsequent panels. Both the salvage slurry and the makeup slurry carry with them variable amounts of heat which impart to the slurry in the container 13 a variable temperature and viscosity. By cooling the mixed slurry to a substantially constant temperature, the variable amount of heat carried into the slurry in the dispenser storage container is removed, and the coating process is started at substantially the same slurry temperature and viscosity for successive panels. The heat may be removed by cooling the slurry flowing to and/or from the dispensing nozzle 49. Alternatively, the heat may be removed by cooling the slurry flowing through the dispenser recirculating 17, or the excess slurry return line 27, or a combination of these cooling steps.

The TABLE shows some specific values for the temperatures in ° C of the panel, and viscosities in centipoises and slurries for green slurry, blue slurry, and red slurry together with some screen weights in mg/cm$^2$ achieved with these conditions. The colors green, blue and red refer to the cathodoluminescent emission colors of the phosphor particles contained in the slurry. For comparison, some typical values of similar characteristics employed in a prior method are also given. Also included are some comparative typical values for the weight ratios of filler resin/pva and phosphor/pva in slurries containing polyvinyl alcohol (pva) as the binder and an acrylic resin in emulsion form as the filler resin. The values for temperatures, viscosities, and for the ratios given for the prior method are necessarily approximate and may be varied from the values given in the TABLE. The prior method includes the direct return of salvage slurry to the dispenser storage container, but does not include the step of removing heat carried into the system with the salvaged slurry as provided in the novel method.

TABLE

| | New Method | | | Prior Method | | |
|---|---|---|---|---|---|---|
| | Green | Blue | Red | Green | Blue | Red |
| Dispenser Storage Container Temp. ° C | 23 | 24 | 24 | 28* | 28* | 28* |
| Dispensing Nozzle Temp. ° C | 20 | 22 | 21.5 | 28* | 28* | 28* |
| Center of Window Temp. ° C | 44+ | 45 | 48 | 38 | 38 | 38 |
| Edge of Window Temp. ° C | 40+ | 42 | 44+ | 32 | 32 | 32 |
| Dispenser Storage Container Viscosity cps | 38.0 | 40.0 | 40.0 | 55 | 55 | 55 |
| Dispensing Nozzle Viscosity cps | 43.0 | 45.5 | 43.5 | 55 | 55 | 55 |
| Ratio - Filler Resin/pva | 0.05 | 0.05 | 0.05 | 0.50 | 0.50 | 1.00 |
| Ratio - pva/Phosphor | 0.09 | 0.09 | 0.09 | 0.12 | 0.12 | 0.12 |
| Center Screen Weight | 4.3 | 4.3 | 3.8 | 3.4 | 3.6 | 2.7 |
| Edge Screen Weight | 3.8 | 3.7 | 3.4 | | | |
| Specific Gravity of Slurry | 1270 | 1270 | 1270 | | | |

*temperature fluctuates in range of about 26° to 30° C

I claim:

1. A method for coating the inner surface of a cathode-ray-tube viewing window with particulate material comprising A. heating said window to temperatures above 35° C, B. dispensing from a storage container onto said heated inner surface a quantity of slurry comprised of said particulate material mixed with a liquid vehicle, said quantity of slurry being in excess of that required for coating said surface and having at temperature below 22° C, C. spreading said quantity of slurry over said surface, whereby amounts of heat are transferred to said quantity of slurry from said surface, D. collecting the excess slurry from said surface and returning it to said storage container, E. and removing the amounts of heat transferred to said excess slurry from said surface.

2. The method defined in claim 1 wherein said slurry is dispensed through a dispensing means and said heat is removed by cooling said slurry to temperatures lower than 22° C as it passes between said storage container and said dispensing means.

3. The method defined in claim 1 wherein said heat is removed by cooling said slurry in said storage container to temperatures lower than 22° C.

4. The method defined in claim 1 wherein, at said dispensing, said slurry temperature is about 20° to 21° C and said slurry viscosity is at about 35 to 45 centipoises.

5. In a method for coating the inner surfaces of a plurality of cathode-ray-tube viewing windows with particles of phosphor material comprising passing said viewing windows in a series and carrying out the following steps for each of said surfaces;

A. rotating said inner surfaces facing upwardly about an axis that is substantially normal to and passes through the central portion of said surface, B. heating said surface to temperatures above 35° C, C. dispensing from a storage container onto said rotating surface a quantity of slurry comprised of said phosphor particles, a binder for said particles, a photosensitizer for said binder and a liquid vehicle, said quantity of slurry being in excess of that required for coating said surface, D. tilting said axis to cause said dispensed slurry to spread across said rotating surface, said slurry being heated by contact with said surface, E. collecting the excess slurry from said surface, F. returning said excess slurry to said storage container, G. and mixing said returned excess slurry with the slurry in said storage container, whereby the temperature of said mixed slurry rises above 22° C, the improvement comprising cooling said quantity of slurry to a temperature lower than 22° C.

6. The method defined in claim 5 wherein said cooled slurry has a viscosity of about 30 to 50 centipoises.

7. The method defined in claim 5 wherein a makeup slurry is also added to said storage container and mixed therein to produce a mixed slurry for use in coating subsequent viewing-window surfaces.

8. The method defined in claim 5 wherein the slurry is dispensed through a dispensing means and said cooling is achieved by passing said slurry through a cooling means between said storage container and said dispensing means.

9. The method defined in claim 5 wherein the central portion of said surface has a temperature of about 42° to 50° C, and the edge portions thereof are 3° to 5° cooler than said central portion.

* * * * *